US012471680B2

(12) United States Patent
Cope et al.

(10) Patent No.: US 12,471,680 B2
(45) Date of Patent: Nov. 18, 2025

(54) LOCKING ZIPPER PULLS

(71) Applicant: WANDRD, LLC, Orem, UT (US)

(72) Inventors: Spencer N. Cope, Orem, UT (US); Ryan M. Cope, Orem, UT (US); Austin J. Cope, Orem, UT (US)

(73) Assignee: WANDRD, LLC, Orem, UT (US)

( * ) Notice: Subject to any disclaimer, the term of this patent is extended or adjusted under 35 U.S.C. 154(b) by 0 days.

(21) Appl. No.: 18/195,919

(22) Filed: May 10, 2023

(65) Prior Publication Data

US 2024/0373994 A1 Nov. 14, 2024

(51) Int. Cl.
*A44B 19/30* (2006.01)
*A44B 19/26* (2006.01)

(52) U.S. Cl.
CPC ..... *A44B 19/305* (2013.01); *A44B 19/262* (2013.01)

(58) Field of Classification Search
CPC ..... A44B 19/305; A44B 19/262; A44B 19/26; A44B 19/30; Y10T 24/2589; Y10T 24/2566; Y10T 24/2561; Y10T 24/2509; F16B 21/04
See application file for complete search history.

(56) References Cited

U.S. PATENT DOCUMENTS 3,852,851 A * 12/1974 Higuchi ..... A44B 19/301 24/387
4,790,156 A * 12/1988 Yang ..... A44B 19/301 24/387
5,063,760 A * 11/1991 Horita ..... A44B 19/301 70/68
5,681,115 A * 10/1997 Diederich ..... B65D 33/2541 383/97
6,467,135 B1 * 10/2002 Schuster ..... A44B 19/262 24/387
10,716,379 B2 * 7/2020 Ponti ..... A45C 5/14
11,457,699 B2 * 10/2022 Lee ..... E05B 65/52
2005/0257351 A1 * 11/2005 Pitts ..... A44B 19/301 24/436
2008/0196217 A1 * 8/2008 Eschbach ..... A44B 19/262 24/386
2014/0069757 A1 * 3/2014 Schlipper ..... A44B 19/301 24/386
2016/0338455 A1 * 11/2016 Chuan ..... A44B 19/305
2020/0245731 A1 * 8/2020 Lv ..... A44B 19/301

* cited by examiner

*Primary Examiner* — Jason W San
*Assistant Examiner* — Rowland Do
(74) *Attorney, Agent, or Firm* — DENTONS Durham Jones Pinegar

(57) ABSTRACT

Locking pull-tabs for a zipper include a first pull-tab that may be connected to a first slider and a second pull-tab that may be connected to a second slider of the zipper. The first pull-tab and second pull-tab include a first locking coupler and a second locking coupler, respectively. The first locking coupler and second locking coupler may enable the first pull-tab and second pull-tab to engage each other in a manner that secures a zipper in a closed arrangement and, thus, provides some security to contents of an item that are enclosed in the item with the zipper. The first locking coupler and second locking coupler may engage each other in a manner that requires intentional and conspicuous manipulation of the first pull-tab and second pull-tab to uncouple them. Methods for locking a zipper are also disclosed.

3 Claims, 14 Drawing Sheets

LOCKING ZIPPER PULLS

TECHNICAL FIELD

This disclosure relates generally to zippers and, more specifically, to locking zippers. Even more specifically, this disclosure relates to zippers with pairs of zipper pulls that include pull-tabs that lock together. This disclosure also relates to methods for locking the pull-tabs of two zipper pulls together.

RELATED ART

Zippers are commonly used to close and secure a variety of different items, from backpacks and other bags, to jackets and clothing items, to luggage and other types of vessels. A zipper includes a zipper pull with a slider body for engaging with a track of teeth of the zipper and a pull-tab attached to the slider body, where the pull allows for manipulation of the slider body along the track.

Solutions for locking zippers have included elements to prevent the slider of the zipper from moving along the track. Other solutions have included external locking elements that can be threaded through zipper pulls to lock the zipper pulls together, such as small padlocks. Still other solutions include external locking elements, such as combination locked slots that receive zipper pulls and lock them within the slots. However, each of these solutions have their own drawbacks, such as being susceptible to opening under applications of force or requiring a combination to unlock the zipper.

SUMMARY

Disclosed are zippers and zipper pulls that can be locked together, as well as to devices and systems that include such a zipper and to methods of using such a zipper. A zipper includes a tape, at least one first stop, a track of teeth, at least one second stop, and a pair of pulls, or sliders. The tape includes two sides. The at least one first stop may join (permanently or selectively, by way of a retainer box and an insertion pin on one side of the tape) the two sides of the tape together. Each side of the tape may carry teeth, or elements, with the teeth or arranged in such a way that teeth on one side of the tape may engage, or be meshed together with, alternating teeth on the other side of the tape as the zipper is closed and disengage, or pulled apart from, the alternating teeth on the other side of the tape as the zipper is opened. The at least one second stop is located on an opposite side of the teeth from the at least one first stop and may join the two sides of the tape together. Each pull, or slider, may include a slider body and a pull-tab. The pull-tab enables an individual to grasp the pull and slide the slider body along the tape in a desired direction. The slider body moves along the tape and the teeth to selectively join or separate the teeth, depending on the direction in which the pull is moved.

Each pull, or slider, of a zipper may be referred to herein as a "zipper pull." A first pull-tab of a first zipper pull of the zipper has a first pull-tab body. The first pull-tab body includes a first locking coupler. At least one first connector may connect the first pull-tab to a first slider body of the first zipper pull. The at least one first connector may include a flexible elongated element (e.g., a cord, a cable, a strap, a tie, a string, another fastener, etc.). A second pull-tab of a second zipper pull of the zipper has a second pull-tab body. The second pull-tab body includes a second locking coupler. At least one second connector may connect the second pull-tab to a second slider body of the second zipper pull. The at least one second connector may include a flexible elongated element (e.g., a cord, a cable, a strap, a tie, a string, another fastener, etc.) that couples the second pull-tab to the second slider body of the second zipper pull. Together, the first pull-tab and second pull-tab may define a zipper lock, with the first locking coupler of the first pull-tab of the first zipper pull and the second locking coupler of the second pull-tab of the second zipper pull able to selectively engage each other to lock the first pull-tab and second pull-tab and, thus, the first zipper pull and the second zipper pull together to effectively lock the zipper. In some embodiments, the first pull-tab and second pull tab of the zipper lock may be rotated between a first open position and a first locked position. Additionally, the first pull-tab and second pull tab may be rotated between a second open position and a second locked position, with the first locked position being different from the second locked position.

In some embodiments, each pull-tab of a zipper pull includes a somewhat triangular pull-tab body. A pair of connectors may protrude from corners of the pull-tab body and be attachable to a slider body of the zipper pull. The locking coupler of the pull-tab may be located adjacent to another corner, or an apex of the pull-tab body. A first locking coupler of a first pull-tab of a first zipper pull may comprise an opening or void in the pull-tab body of the first pull-tab, while a second locking coupler of a second pull-tab of a second zipper pull may comprise a protrusion from the pull-tab body of the second pull-tab that is complementary to, may be received by, and may selectively engage the first locking coupler.

The first pull-tab and the second pull-tab of the zipper lock have a first unlocked, or open, arrangement, where the first pull-tab and the second pull-tab are partially superimposed with the second locking coupler received by the first locking coupler and the second pull-tab oriented at about 90° to the first pull-tab. The first pull-tab and the second pull-tab of the zipper lock also have a first locked arrangement, where the first pull-tab and the second pull-tab are partially superimposed with the second locking coupler received by the first locking coupler and the second pull-tab oriented about 180° to the first pull-tab. The first pull-tab and second pull-tab may also have a second unlocked, or open, arrangement, where the first pull-tab and the second pull-tab are partially superimposed with the second locking coupler received by the first locking coupler and the second pull-tab oriented at about 270° to the first pull-tab. In addition, the first pull-tab and second pull-tab may have a second locked arrangement, where the first pull-tab and the second pull-tab are substantially or completely superimposed (i.e., the second pull-tab is oriented about 0° to the first pull-tab) with the second locking coupler received by the first locking coupler. Upon inserting the second locking coupler into the first locking coupler of the first pull-tab in the first unlocked arrangement, a transition from the first open arrangement to the first locked arrangement may include an approximately 90° rotation of the second pull-tab relative to the first pull-tab. Upon inserting the second locking coupler into the first locking coupler of the first pull-tab in the second unlocked arrangement, a transition from the second unlocked arrangement to the second locked arrangement may include an approximately 90° rotation of the second pull-tab relative to the first pull-tab.

A method of locking a zipper may include mating a first locking coupler of a first pull-tab of a first zipper pull with a second locking coupler of a second pull-tab of a second zipper pull and rotating the second pull-tab approximately 90° (relative to the first pull-tab) to a locked position, placing the zipper lock in a locked arrangement. The second pull-tab may be rotated approximately 90° clockwise and/or approximately 90° counterclockwise to arrive at the locked position. When in the locked position, the first pull-tab and second pull-tab may be substantially or completely superimposed with each other (e.g., oriented at an angle of about 0° relative to each other) or partially superimposed and oriented at an angle of about 180° to each other.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
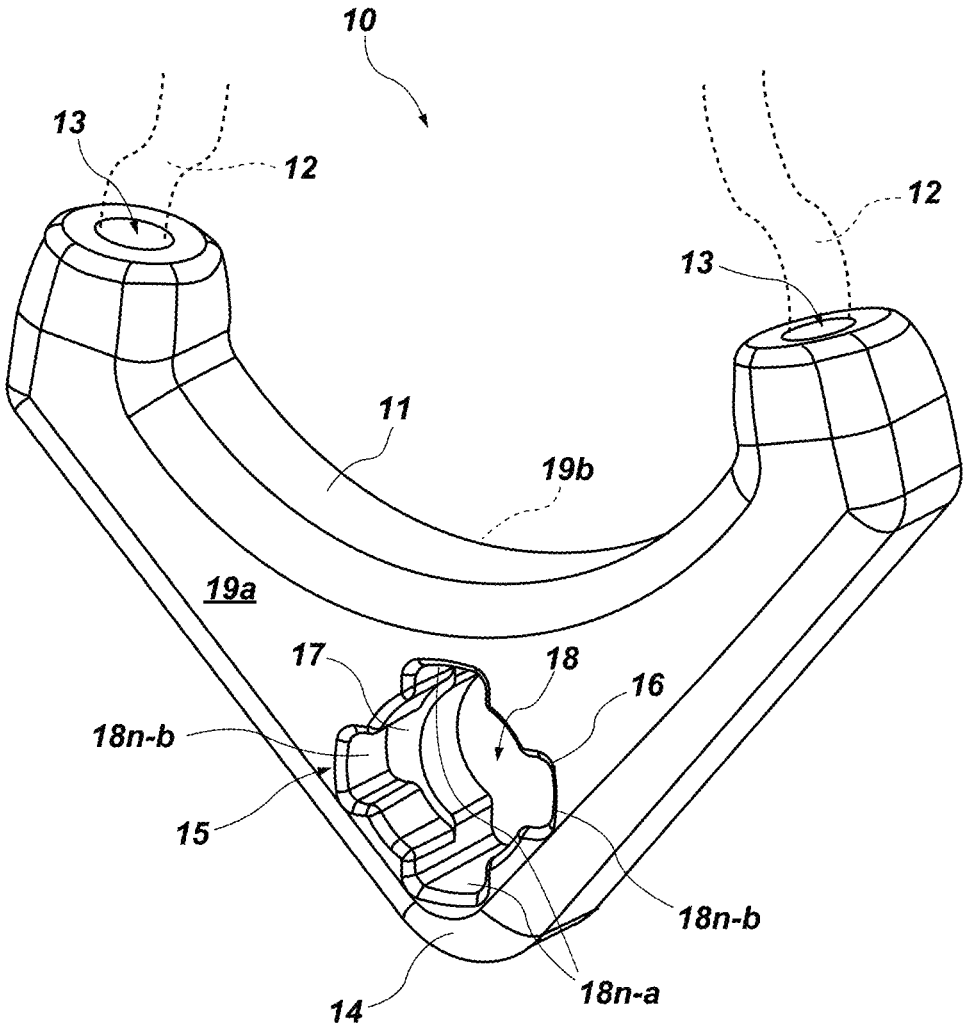
FIG. 1 is a front isometric view of an embodiment of a first zipper pull-tab of a first zipper pull of a zipper.
Figure 2A:
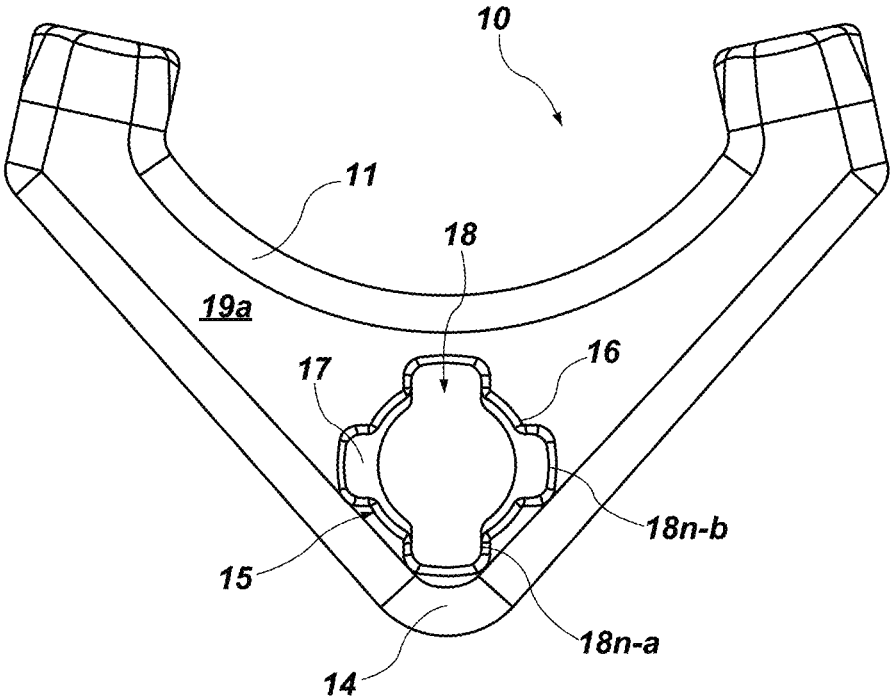
FIG. 2A is a front plan view of the first pull-tab of FIG. 1.
Figure 2B:
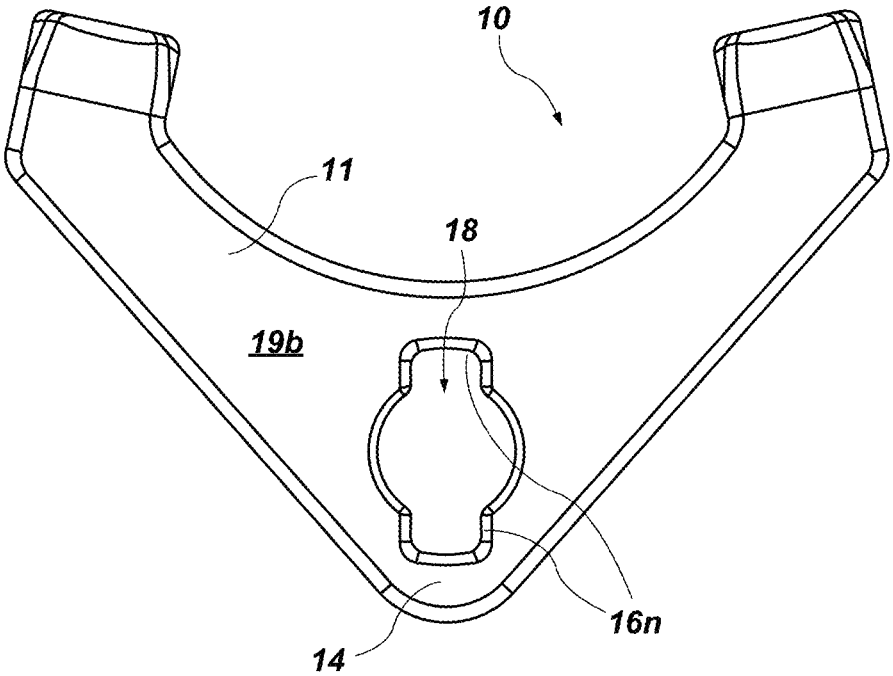
FIG. 2B is a rear plan view of the first pull-tab of FIG. 1.

FIGS. 1-2B illustrate an embodiment of a first pull-tab 10 of a zipper pull of a zipper of this disclosure. As illustrated, the pull-tab 10 includes a pull-tab body 11 a with a first locking coupler 15. The pull-tab body 11 also includes a front face 19*a* and a back face 19*b* opposite from the front face 19*a*. The pull-tab body 11 may be somewhat triangular in shape, though other shapes and dimensions are contemplated herein. As illustrated, the pull-tab body 11 may be somewhat triangular and includes an apex 14. At least one first connector 12 may extend from the pull-tab body 11. The at least one first connector 12 can include two ends, each secured within a hole 13 in the pull-tab body 11 of the first pull-tab 10. In embodiments where the pull-tab body 11 is somewhat triangular, each end of the first connector 12 may be secured within a hole 13 at or adjacent to a corner of the pull-tab body 11. The first connector 12 may comprise a flexible elongated element, for example, a cord, a cable, a strap, a tie, a string, or another fastener for attaching the first pull-tab 10 to a first slider body of the first zipper pull. The zipper, the first zipper pull of the zipper, and, thus, the first pull-tab 10 may be integrated into any suitable item, such as a bag (e.g., a backpack, a sling bag, etc.), luggage (e.g., a suitcase, a garment bag, etc.), an item of apparel, or any other item having a zipper.

In some embodiments, the first locking coupler 15 is defined by and extends through the pull-tab body 11, adjacent to the apex 14. In some embodiments, the first locking coupler 15 is defined by and extends through the pull-tab body 11, just above the apex 14. The first locking coupler 15 extends from the front face 19*a*, through the pull-tab body 11, to the back face 19*b*. The first locking coupler 15 includes a first void 16 in the front face 19*a*, a second void 18 in the back face 19*b*, and a retaining wall 17 between the front face 19*a* and back face 19*b*. The first void 16 and the second void 18 may be aligned (e.g., concentrically aligned, etc.) and communicate with each other. The shapes of the first void 16 and second void 18 may not be identical; thus, the first void 16 and second void 18 may not be completely aligned with each other. The retaining wall 17 may be located along a boundary between the first void 16 and second void 18 at locations where the first void 16 and second void 18 are not aligned. As illustrated, the first void 16 may have the shape of a cruciform with rounded ends (which define four notches 16*n* of the first void 16, or two diametrically opposed pairs of notches 16*n*, including a first pair of notches 16*n-a* and a second pair of notches 16*n-b*) and a circular opening 16*c* at a center of the cruciform, though other shapes are contemplated herein.

FIG. 2A shows the front face 19*a* of the first pull-tab 10 and FIG. 2B illustrates the back face 19*b* of the first pull-tab 10. The first void 16 is defined within the front face 19*a* and extends partially through a thickness of the pull-tab body 11, with the retaining wall 17 being located at ends (relative to the thickness of the pull-tab body 11) of the second pair of notches 16*n-b* of the first void 16. The second void 18 extends through a remainder of the thickness of the pull-tab body 11, from the retaining wall 17 to the back face 19*b*. As illustrated, the second void 18 may have the shape of an elongated rectangle with rounded ends superimposed with a smaller circular opening 18*c*. The rounded ends of the elongated rectangle define two notches 18*n* of the second void 18, as opposed to the four notches 16*n* (i.e., the first pair of notches 16*n-a* and second pair of notches 16*n-b*) of the first void 16. The two notches 18*n* may be diametrically opposed to each other and aligned with the first pair of notches 16*n-a* of the first void 16. The circular opening 18*c* of the second void 18 may be aligned with and have substantially the same dimensions as or the same dimensions as the circular center 16*c* of the first void 16. The first connectors 12 are illustrated by FIG. 1 as extending symmetrically from the pull-tab body 11. In some embodiments, the front face 19*a* includes beveling or rounded edges, while the back face 19*b* is substantially flat or planar.

Figure 3:
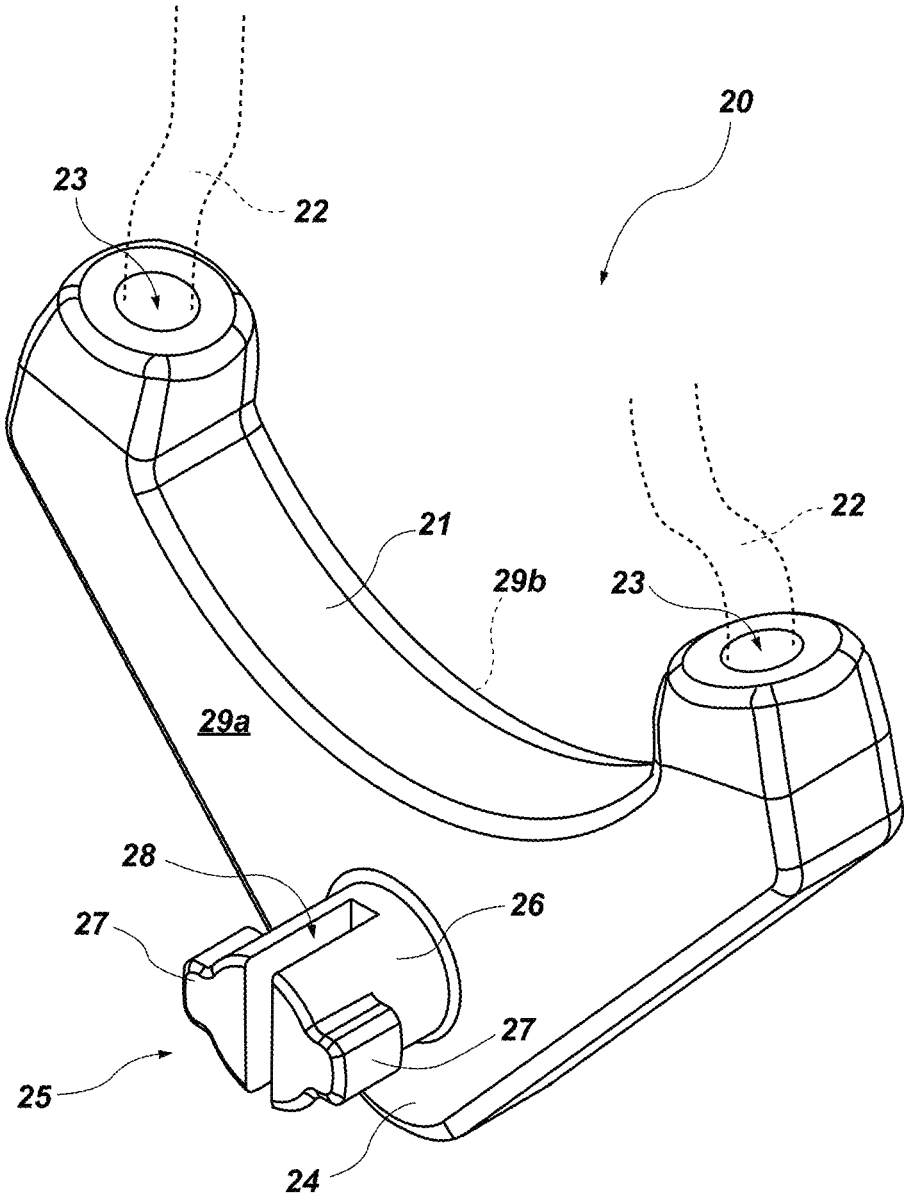
FIG. 3 is a front isometric view of an embodiment of a second pull-tab of a second zipper pull of the zipper, which may be used in conjunction with the first pull-tab of FIG. 1.
Figure 4A:
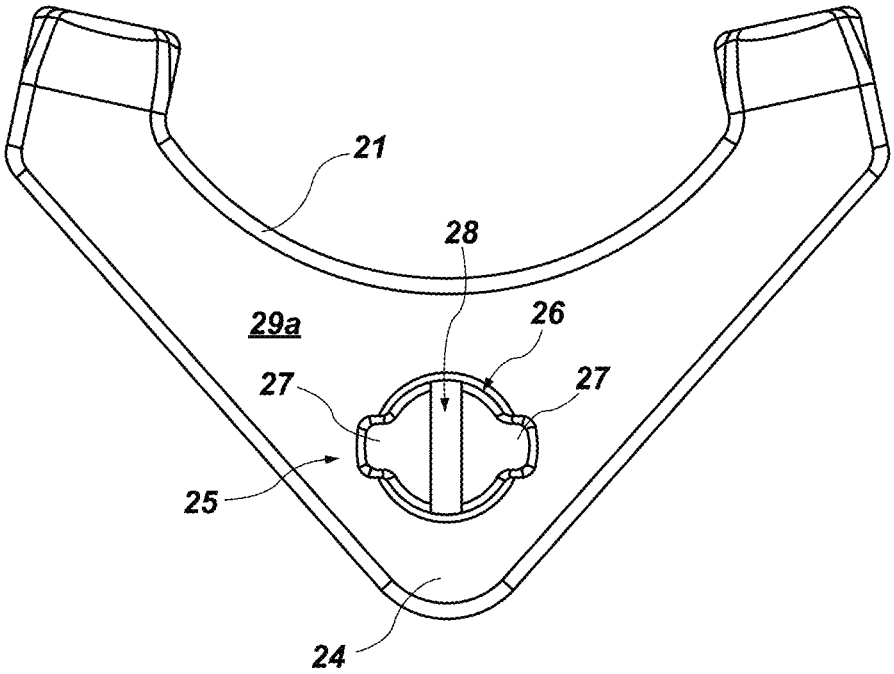
FIG. 4A is a front plan view of the second pull-tab of FIG. 3.
Figure 4B:
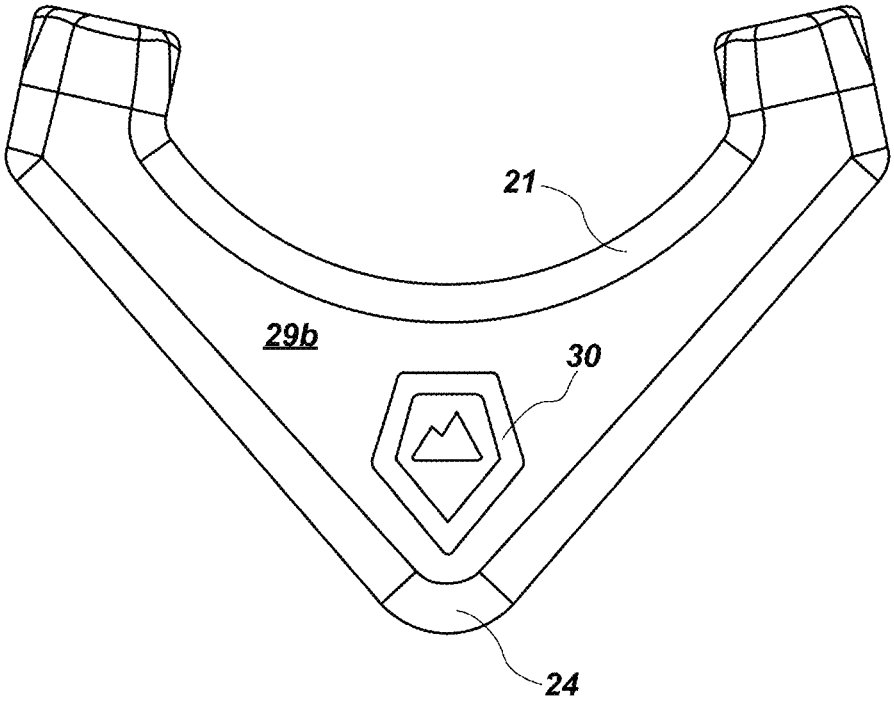
FIG. 4B is a rear plan view of the second pull-tab of FIG. 3.
Figure 5:
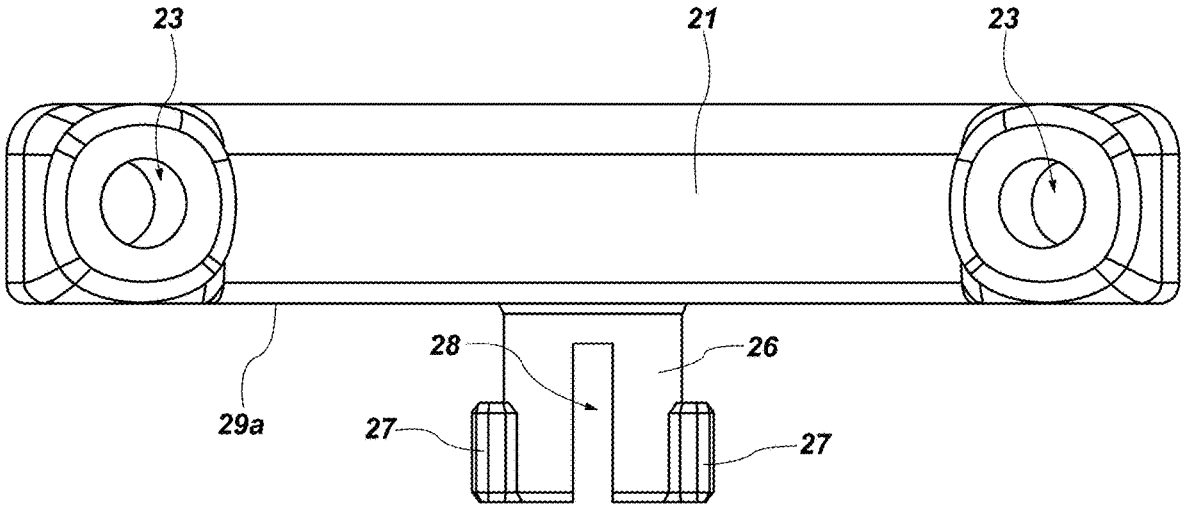
FIG. 5 is a top plan view of the second pull-tab of FIG. 3.

FIGS. 3-5 illustrate a second pull-tab 20 of a second zipper pull of the zipper. As illustrated, the second pull-tab 20 includes a pull-tab body 21 with a second locking coupler 25 protruding therefrom. The pull-tab body 21 also includes a back face 29*a* and a front face 29*b* opposite the back face 29*a*. In some embodiments, the pull-tab body 21 may be somewhat triangular in shape, though other shapes and dimensions are contemplated herein. In some embodiments, an outer periphery of the pull-tab body 21 may have substantially the shape and dimensions or the same shape and dimensions as the pull-tab body 11 of the first pull-tab 10 (FIGS. 1-2B). As illustrated, the pull-tab body 21 may include an apex 24. At least one second connector 22 may extend from the pull-tab body 21. The at least one second connector 22 may include two ends, with each end being secured within a hole 23 in the pull-tab body 21 of the second pull-tab 20. In embodiments where the pull-tab body 21 is somewhat triangular, each end of the second connector 22 may be secured within a hole 23 at or adjacent to a corner of the pull-tab body 21. The second connector(s) 22 may comprise a flexible elongated element, for example, a cord, a cable, a strap, a tie, a string, or another fastener, for attaching the second pull-tab 20 to a second slider body of the second zipper pull.

In some embodiments, the second locking coupler 25 includes a protrusion 26 having at least one tab 27 and a slot 28. In some embodiments, the protrusion 26 is located just above the apex 24 and protrudes away from the back face 29*a* of the pull-tab body 21 (e.g., perpendicularly, at a non-perpendicular angle, etc.). The slot 28 may extend centrally through (e.g., along a diameter of, etc.) the protrusion 26. The at least one tab 27 may extend laterally (e.g., circumferentially, etc.) from the protrusion 26 at or adjacent to a tip of the protrusion 26. The second locking coupler 25 may include two (2) tabs 27 disposed symmetrically about the slot 28 (i.e., on opposite sides of the slot 28—they may be diametrically opposed, etc.). The protrusion 26 is sized and shaped to be received by and mate with the first locking coupler 15 of the first pull-tab 10. Concomitantly, the first locking coupler 15 is sized and shaped to mate with and receive the protrusion 26 of the second pull-tab 20. The tabs 27 of the second locking coupler 25 may have shapes and arrangement that correspond to the shapes and arrangement of notches 16*n* of the first void 16 and second void 18 and portions of the retaining wall 17, enabling them to pass through the notches 18*n* of the second void 18 and be received and engaged by the notches 16*n* of the first void 16, and rest against the portions of the retaining wall 17. The slot 28 of the second locking coupler 25 enables the tabs 27 to be pressed toward each other (i.e., toward a longitudinal axis of the protrusion 26) in a stressed state of the second locking coupler 25 then resiliently return to their original positions in a relaxed state of the second locking coupler 25. The slot 28 may thereby enable the tabs 27 to be pressed together in the stressed state to move between the first pair of notches 16*n-a* of the first void 16 and the second pair of notches 16*n-b* of the first void 16. The tabs 27 may snap back into place upon being received by the first pair of notches 16*n-a* or the second pair of notches 16*n-b*.

Specifically, referring to FIGS. 1 and 3 together, the protrusion 26 may be inserted into and through the second void 18 by aligning the tabs 27 with the notches 18*n* of the second void 18. The notches 18*n* of the second void 18 are aligned with the first pair of notches 16*n-a* of the first void 16, allowing the protrusion 26 and the tabs 27 to extend through the second void 18 and into the first void 16. The slot 28 in the protrusion 26, between the tabs 27, provides the protrusion 26 with some flex, which may assist in insertion of the protrusion 26 and tabs 27 into the first locking coupler 15. Upon rotation of the second pull-tab 20 relative to the first pull-tab 10, discussed more fully below, slot 28 may enable the tabs 27 to be pressed together by a surface of the first void 16, placing the second locking coupler 25 in its stressed state. As the tabs 27 are rotated into the second pair of slots 16*n-b* of the first void 16, they resiliently snap back, returning the second locking coupler 25 to its relaxed state, and the tabs 27 come into contact with the retaining wall 17, which prevents the second locking coupler 25 of the second pull-tab 20 from being pulled back through the first locking coupler 15 (i.e., the first void 16 and second void 18). With the tabs 27 resiliently and reversibly locked into the second pair of slots 16*n-b*, the first pull-tab 10 and the second pull-tab 20 are placed in a locked arrangement.

FIG. 4A shows that the front face 29*b* of the pull-tab body 21 may include a graphic or indicia 30, which may be a logo, trademark, or other company-identifying graphic 30. In some embodiments, the front face 29*b* of the pull-tab body 21 includes beveled or rounded edges, while the back face 29*a* is substantially flat or planar (other than the protrusion 26).

The second pull-tab 20 and the second zipper pull of which the second pull-tab 20 is a part may be part of a zipper that also includes the first zipper pull and its first pull-tab 10. Again, such a zipper may be integrated into any suitable item, such as a bag (e.g., a backpack, a sling bag, etc.), luggage (e.g., a suitcase, a garment bag, etc.), an item of apparel, or any other item having a zipper.

Figure 6:
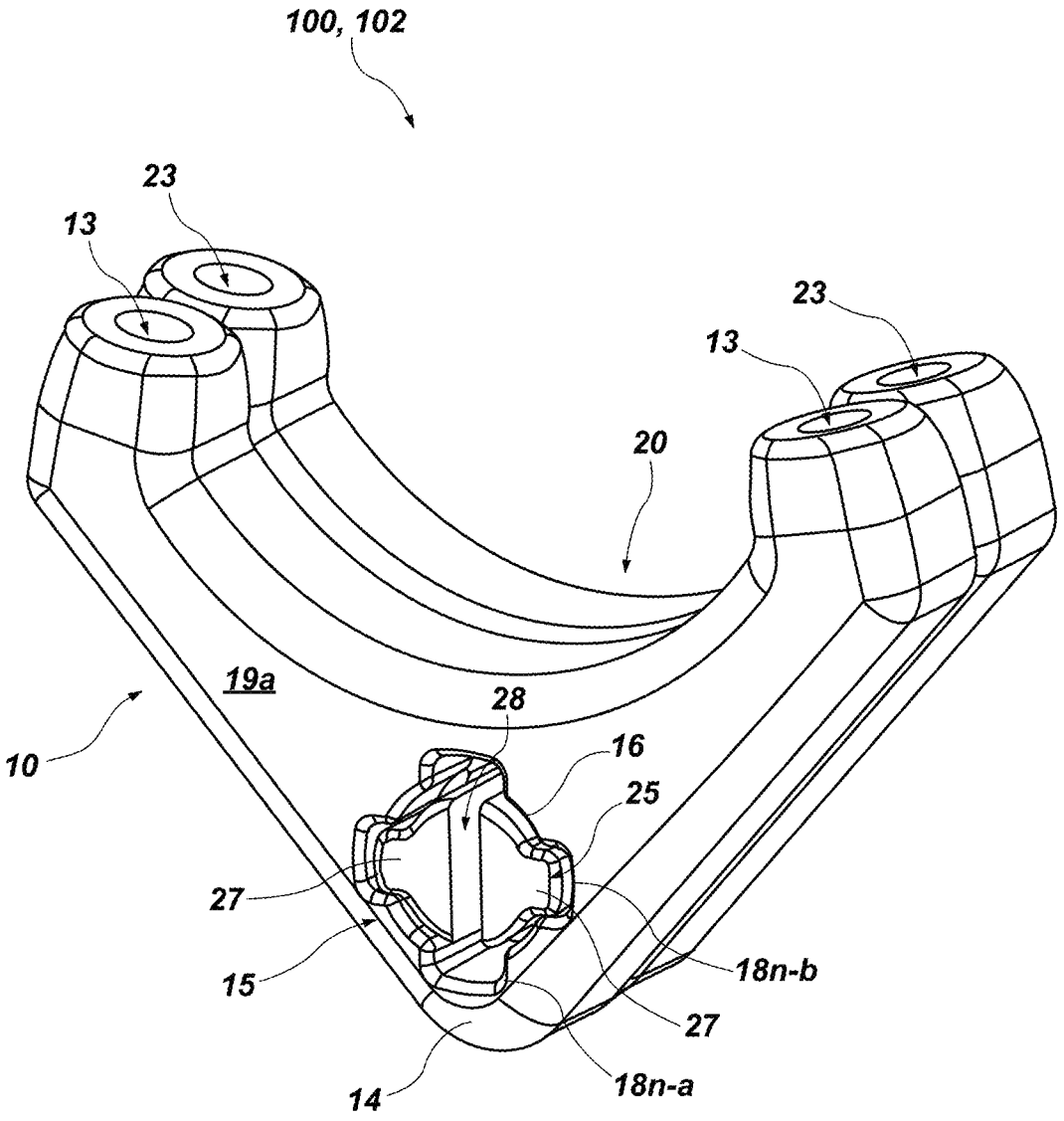
FIG. 6 is a front isometric view of a first locked arrangement a zipper lock including the first pull-tab of FIG. 1 and the second pull-tab of FIG. 3.
Figure 7:
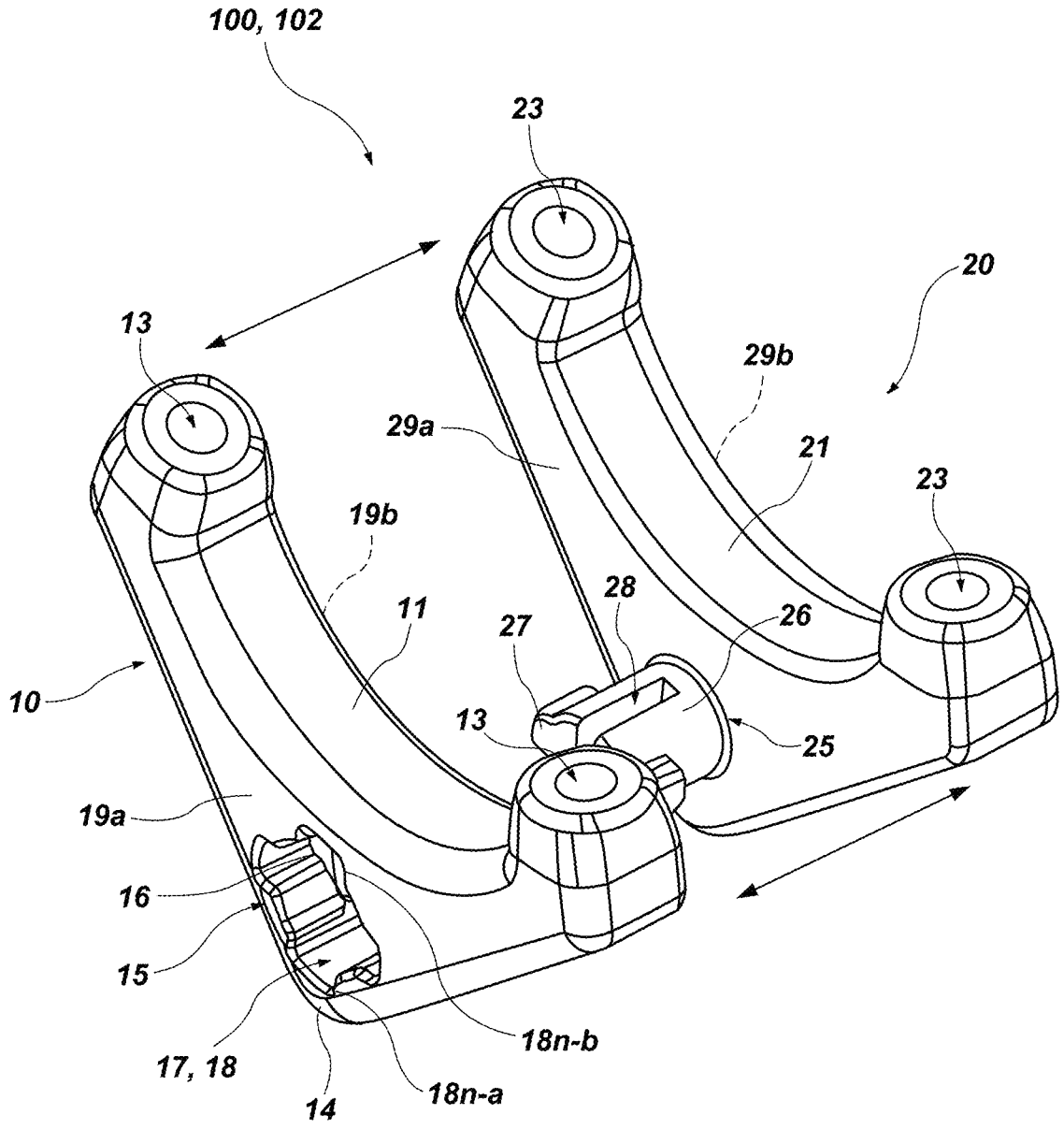
FIG. 7 is an exploded isometric view of the zipper lock with the zipper lock in the first locked arrangement of FIG. 6.

FIG. 6 is a front isometric view and FIG. 7 is an exploded view of a first locked arrangement 102 of a zipper lock 100 utilizing the first pull-tab 10 of FIG. 1 and the second pull-tab 20 of FIG. 3. The first pull-tab 10 and second pull-tab 20 may be joined or mated together by way of the first locking coupler 15 and second locking coupler 25. When joined together in the first locked arrangement 102, the first pull-tab 10 and second pull-tab 20 are substantially or completely aligned with each other (i.e., oriented at an angle of about 0° to each other). For example, their apexes 14, 24 (FIG. 7) and corners are aligned or superimposed with each other.

As clearly visible in FIG. 6, the second locking coupler 25 is received by the first locking coupler 15. A length of the second locking coupler 25 may correspond to (i.e., be substantially the same as or the same as) a length of the first locking coupler 15.

As illustrated in FIG. 6, the protrusion 26 of the second locking coupler 25 is fully received by the first locking coupler 15. The tabs 27 are received by the second pair of notches 16*n-b* of the first void 16. The slot 28 in the protrusion 26 of the second locking coupler 25 assists coupling of the second locking coupler 25 with the first locking coupler 15. For example, the slot 28 may allow the tabs 27 to flex inwardly towards the slot 28 during insertion of the second locking coupler 25 within the first locking coupler 15. The slot 28 allows the tabs 27 to flex inwardly towards the slot 28 while rotating the tabs 27 between the first pair of notches 16*n-a* and the second pair of notches 16*n-b* of the first void 16. After the tabs 27 are in place, they may relax and be held within the first pair of notches 16*n-a* or the second pair of notches 16*n-b* of the first void 16 of the first locking coupler 15.

When the tabs 27 of the second locking coupler 15 are positioned within the second pair of notches 16*n-b* of the first void 16 of the first locking coupler 15, the tabs 27 also abut or rest against the retaining wall 17 of the first locking coupler 15. The retaining wall 17 provides a stop for movement of the second locking coupler 25 out of the first locking coupler 15. Specifically, with the tabs 27 abutting the retaining wall 17, the first pull-tab 10 and second pull-tab 20 cannot be pulled apart from each other without intentionally and conspicuously manipulating the first pull-tab 10 and second pull-tab 20 (e.g., by rotating then to an unlocked arrangement, etc.). The retaining wall 17 prevents exit of the tabs 27 and, thus, the second locking coupler 25 from the first locking coupler 15 except upon rotation of the second pull-tab 20 and/or the first pull-tab 10. In this way, the first pull-tab 10 and second pull-tab 20 are locked together and, therefore, would lock the zipper, preventing the zipper and, thus, an item of which the zipper is a part, from being unintentionally or inconspicuously (e.g., by a thief, a child, etc.) opened.

In some embodiments, the second locking coupler 25 may be received by the first locking coupler 15 such that the tip of the protrusion 26 is flush or substantially flush with the front face 19*a* of the pull-tab body 11 of the first pull-tab 10. When the zipper lock 100 is in the first locked arrangement 102, the back face 19*b* of the pull-tab body 11 of the first pull-tab 10 abuts or rests against the back face 29*a* of the pull-tab body 21 of the second pull-tab 20. In some embodiments, an entirety of the back face 19*b* abuts or rests against an entirety of the back face 29*a*. In some embodiments, neither the back face 19*b* nor the back face 29*a* include beveled or rounded edges; the lack of beveled or rounded edges may facilitate a close or tight fit of the pull-tab body 11 of the first pull-tab 10 and the pull-tab body 21 of the second pull-tab 20 against each other. In other embodiments, the front face 19*a* and the front face 29*b* each include beveled or rounded edges, which may facilitate grasping of the zipper lock 100 and/or its first pull-tab 10 and second pull-tab 20 by a user.

Figure 8:
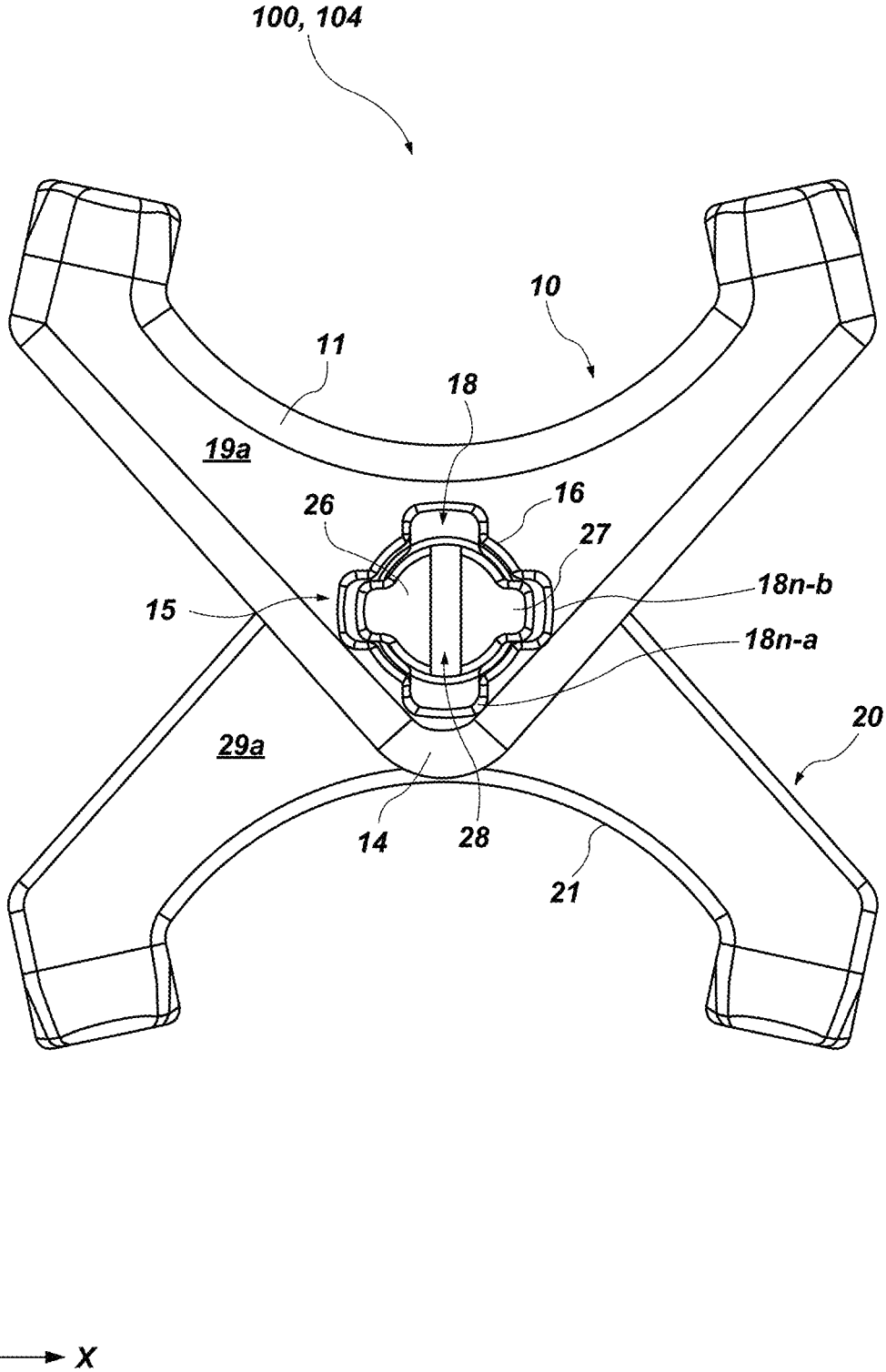
FIG. 8 is a front plan view of a second locked arrangement of a zipper lock including the first pull-tab of FIG. 1 and the second pull-tab of FIG. 3.
Figure 9:
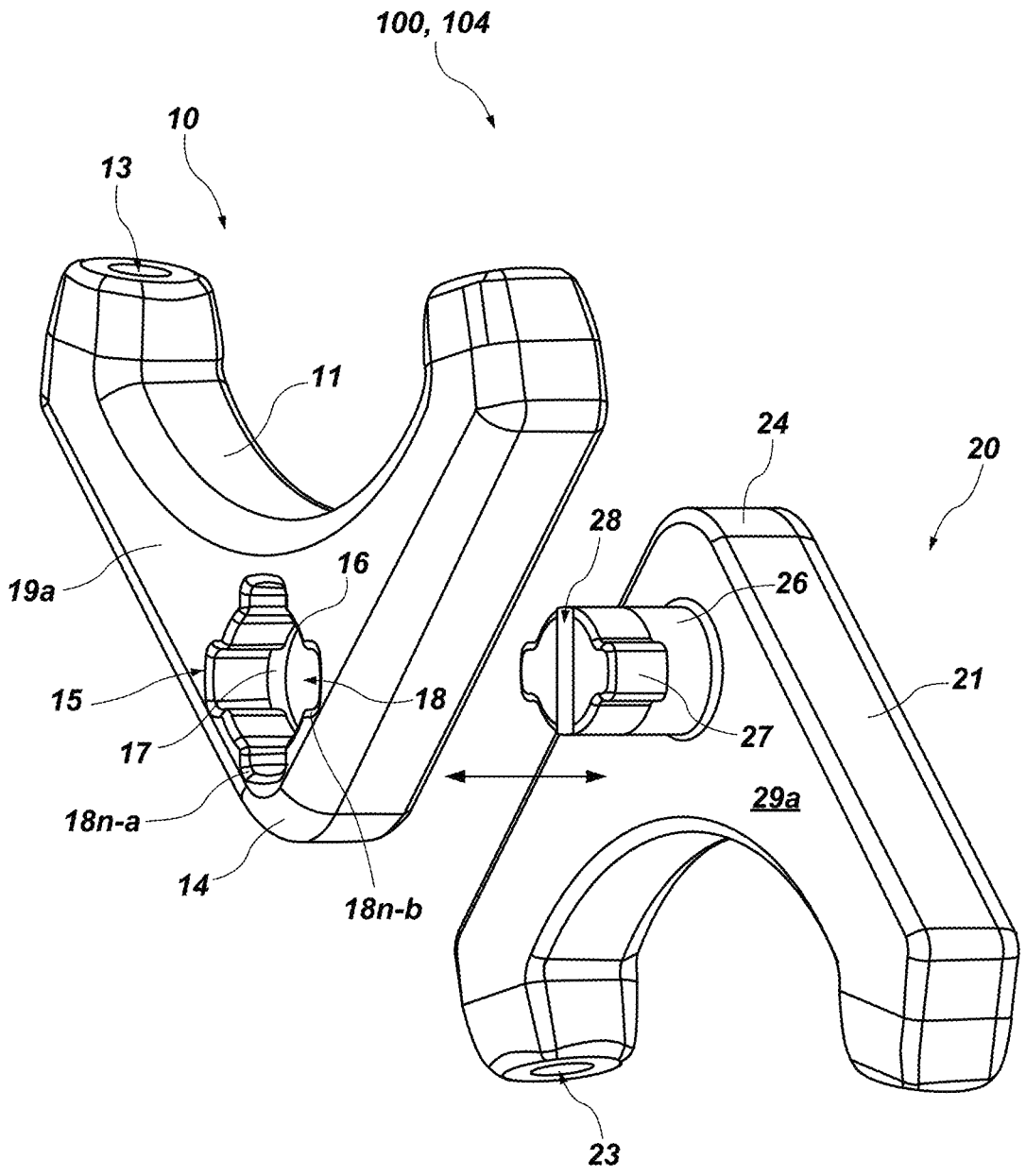
FIG. 9 is an exploded isometric view of the zipper lock with the zipper lock in the second locked arrangement of FIG. 8.

FIG. 8 and FIG. 9 show a second locked arrangement 104 of the zipper lock 100. As illustrated, the first pull-tab 10 (see also FIGS. 1-2B) is joined together with the second pull-tab 20 (see also FIGS. 3-5). The first pull-tab 10 and second pull-tab 20 are joined or mated together by way of the first locking coupler 15 and second locking coupler 25. When joined together in the second locked arrangement 104, the first pull-tab 10 and second pull-tab 20 are oppositely aligned with each other, or oriented at about 180° to each other. For example, the first connectors 12 (FIG. 1) and the second connectors 22 (FIG. 3) may extend in opposite directions from each other. Additionally, the apexes 14 and 24 of the pull-tab bodies 11 and 21 of the first pull-tab 10 and second pull-tab 20, respectively, point in opposite directions.

In the second locked arrangement 104, a portion of the back face 19*b* of the pull-tab body 11 of the first pull-tab 10 abuts or interfaces with a portion of the back face 29*a* of the pull-tab body 21 of the second pull-tab 20. Specifically, overlapping portions of the back face 19*b* and back face 29*a* may abut or rest on each other. For example, the apex 14 and an adjacent portion of the pull-tab body 11 of the first pull-tab 10 may overlap the apex 24 and an adjacent portion of the pull-tab body 21, with corresponding portions of the back face 19*b* of the pull-tab body 11 of the first pull-tab 10 and the back face 29*a* of the pull-tab body 21 of the second pull-tab 20 abutting or resting on each other.

In the second locked arrangement 104, the first locking coupler 15 receives the second locking coupler 25. As in the first locked arrangement 102 of FIGS. 6-7, the length of the second locking coupler 25 may correspond to the length of the first locking coupler 15. As illustrated, the protrusion 26 of the second locking coupler 25 is received by the first locking coupler 15. The tabs 27 are received within a portion of the first void 16. Specifically, the tabs 27 are received by the second pair of notches 16*n-b* of the first void 16. The slot 28 in the protrusion 26 of the second locking coupler 25 assists coupling of the second locking coupler 25 with the first locking coupler 15. For example, the slot 28 may allow the tabs 27 to flex inwardly towards the slot 28 during insertion of the second locking coupler 25 within the first locking coupler 15. The slot 28 allows the tabs 27 to flex inwardly towards the slot 28 while rotating the tabs 27 between the first pair of notches 16*n-a* and the second pair of notches 16*n-b* of the first void 16. After the tabs 27 are in place, they may relax and be held within the first pair of notches 16*n-a* or the second pair of notches 16*n-b* of the first void 16 of the first locking coupler 15.

When the tabs 27 of the second locking coupler 15 are positioned within the second pair of notches 16*n-b* of the first void 16 of the first locking coupler 15, the tabs 27 also abut or rest against the retaining wall 17 of the first locking coupler 15. The retaining wall 17 provides a stop for movement of the second locking coupler 25. Specifically, with the tabs 27 abutting the retaining wall 17, the first pull-tab 10 and second pull-tab 20 cannot be pulled apart from each other without intentionally and conspicuously manipulating the first pull-tab 10 and second pull-tab 20 (e.g., by rotating them to an unlocked arrangement, etc.). The retaining wall 17 prevents exit of the tabs 27 and, thus, the second locking coupler 25 from the first locking coupler 15 except upon rotation of the second pull-tab 20 and/or the first pull-tab 10. In this way, the first pull-tab 10 and second pull-tab 20 are locked together and, therefore, would lock the zipper, preventing the zipper and, thus, an item of which the zipper is a part, from being unintentionally or inconspicuously (e.g., by a thief, a child, etc.) opened.

In some embodiments, the second locking coupler 25 may be received by the first locking coupler 15 such that the tip of the protrusion 26 is flush or substantially flush with the front face 19*a* of the pull-tab body 11 of the first pull-tab 10. As before, the back face 19*b* and the back face 29*a* may lack beveled or rounded edges; the lack of beveled or rounded edges may facilitate a close or tight fit of overlapping portions of the pull-tab body 11 of the first pull-tab 10 and the pull-tab body 21 of the second pull-tab 20 against each other. In other embodiments, the front face 19*a* and the front face 29*b* may each include beveled or rounded edges, which may facilitate grasping of the zipper lock 100 and/or its first pull-tab 10 and second pull-tab 20 by a user.

Figure 10:
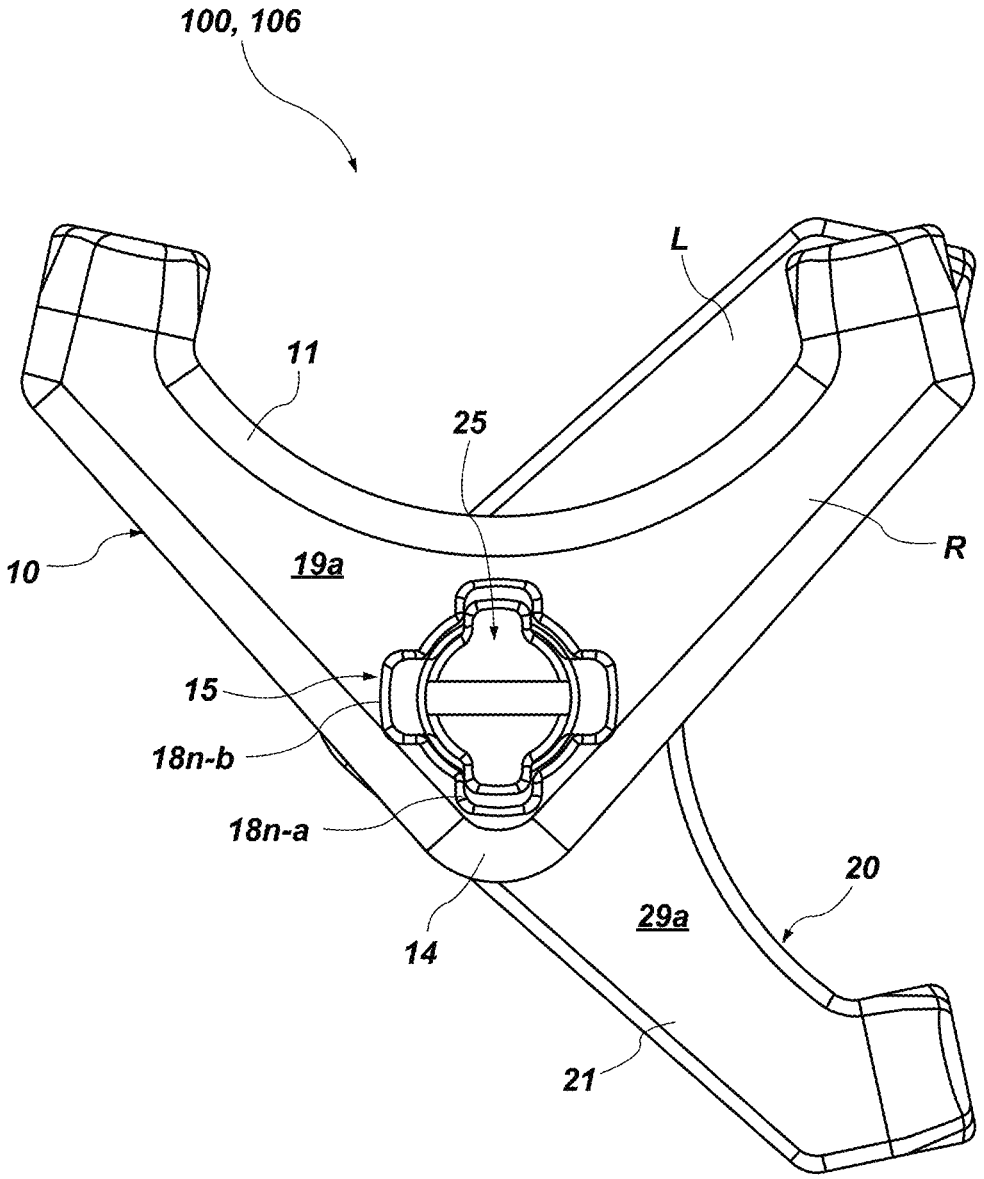
FIG. 10 is a front plan view of a first unlocked arrangement of the zipper locks of FIGS. 6 and 8.
Figure 11:
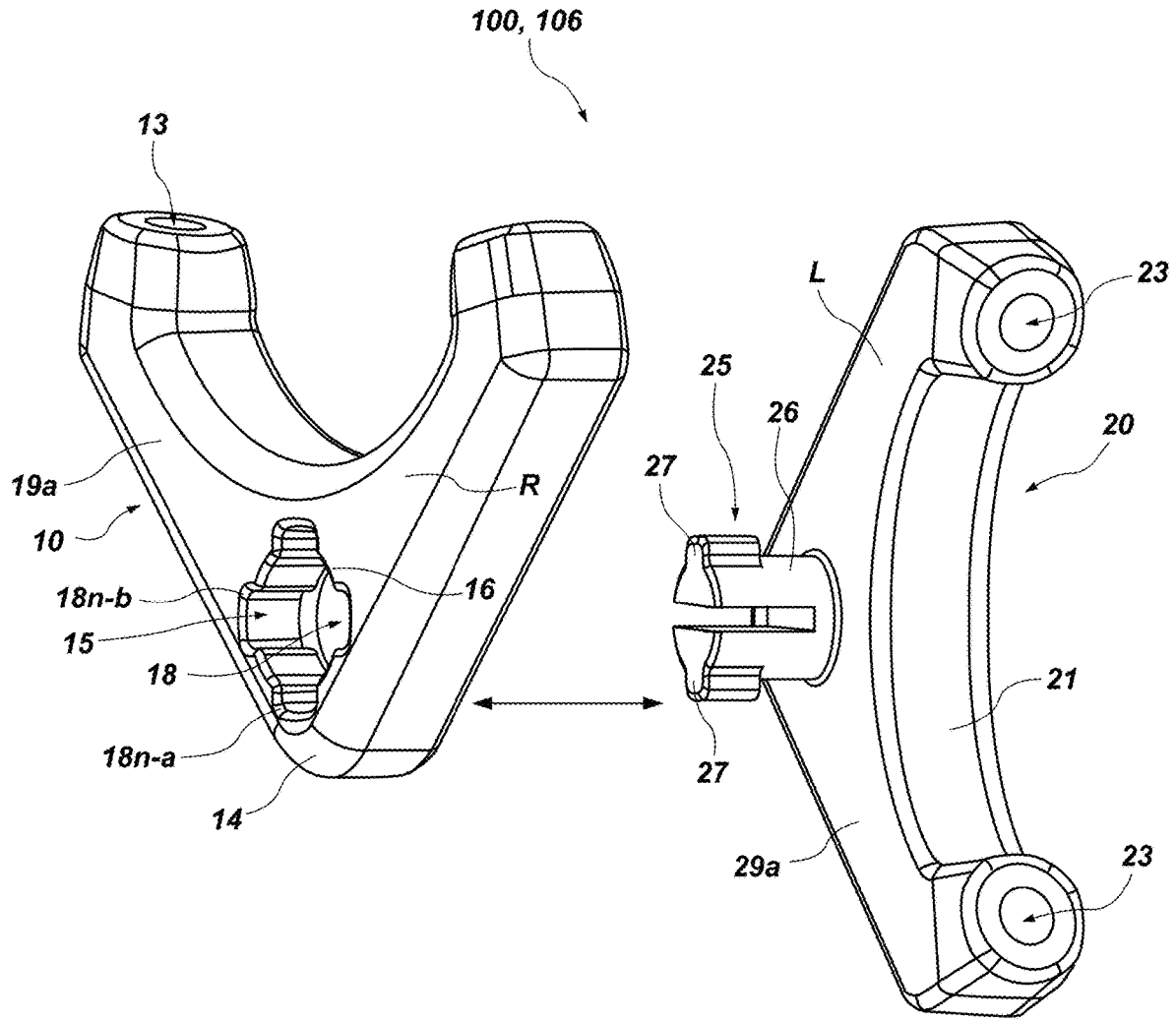
FIG. 11 is an exploded isometric view of the zipper lock with the zipper lock in the first unlocked arrangement of FIG. 10.

FIGS. 10 and FIG. 11 depict a first unlocked arrangement 106 of the zipper lock 100. In the first unlocked arrangement 106, the second pull-tab 20 is oriented approximately 90° clockwise relative to the first pull-tab 10.

In the first unlocked arrangement 106, a portion of the back face 29*a* of the pull-tab body 21 of the second pull-tab 20 abuts or interfaces with a superimposed, opposed portion of the back face 19*b* of the pull-tab body 11 of the first pull-tab 10. Specifically, as seen most clearly in FIG. 11, a portion of the back face 29*a* at a left arm L of the pull-tab body 21 of the second pull-tab 20 overlaps or abuts a portion of the back face 19*b* at a right arm R of the pull-tab body 11 of the first pull-tab 10. The left arm L includes the portion of the pull-tab body 21 extending between the apex 24 and the second connector 22 (FIG. 3) at the top of the left arm L. The right arm R includes the portion of the pull-tab body 11 extending between the apex 14 and the first connector 12 (FIG. 1) at the top of the right arm R.

FIG. 11 also illustrates the orientation of the second pull-tab 20 (e.g., an orientation of about 90° relative to the first pull-tab 10) when the second locking coupler 25 is inserted into the first locking coupler 15 of the first pull-tab 10. Specifically, the tabs 27 are aligned with the notches 18*n* of the second void 18 of the first locking coupler 15 and the first pair of notches 16*n-a* of the first void 16. Such alignment allows the tabs 27 to be inserted first through the second void 18, past the retaining wall 17, and into the first void 16. This insertion places the first pull-tab 10 and second pull-tab 20 in the first unlocked arrangement 106. The second pull-tab 20 can then be rotated counterclockwise 90° to bring the zipper lock 100 into the first locked arrangement 102 (FIGS. 6-7). That is, upon insertion of the tabs 27 into the first void 16 (after having passed the second void 18), the tabs 27 will have advanced past the retaining wall 17, which allows the first pull-tab 10 and second pull-tab 20 to be rotated relative to each other. Additionally, and/or alternatively, the second pull-tab 20 can be rotated clockwise 90° to bring the zipper lock 100 into the second locked arrangement 104 (FIGS. 10-11).

Upon rotation (either clockwise or counterclockwise), the tabs 27 of the second locking coupler 25 will be positioned adjacent to or abut the retaining wall 17 of the first locking coupler 15, preventing the tabs 27 and, thus, the second locking coupler 25 from exiting the first void 16 of the first locking coupler 15. That is, the retaining wall 17 prevents the second locking coupler 25 from being released or pulled out of the first locking coupler 15. In this way, the first pull-tab 10 is locked to the second pull-tab 20.

Figure 12:
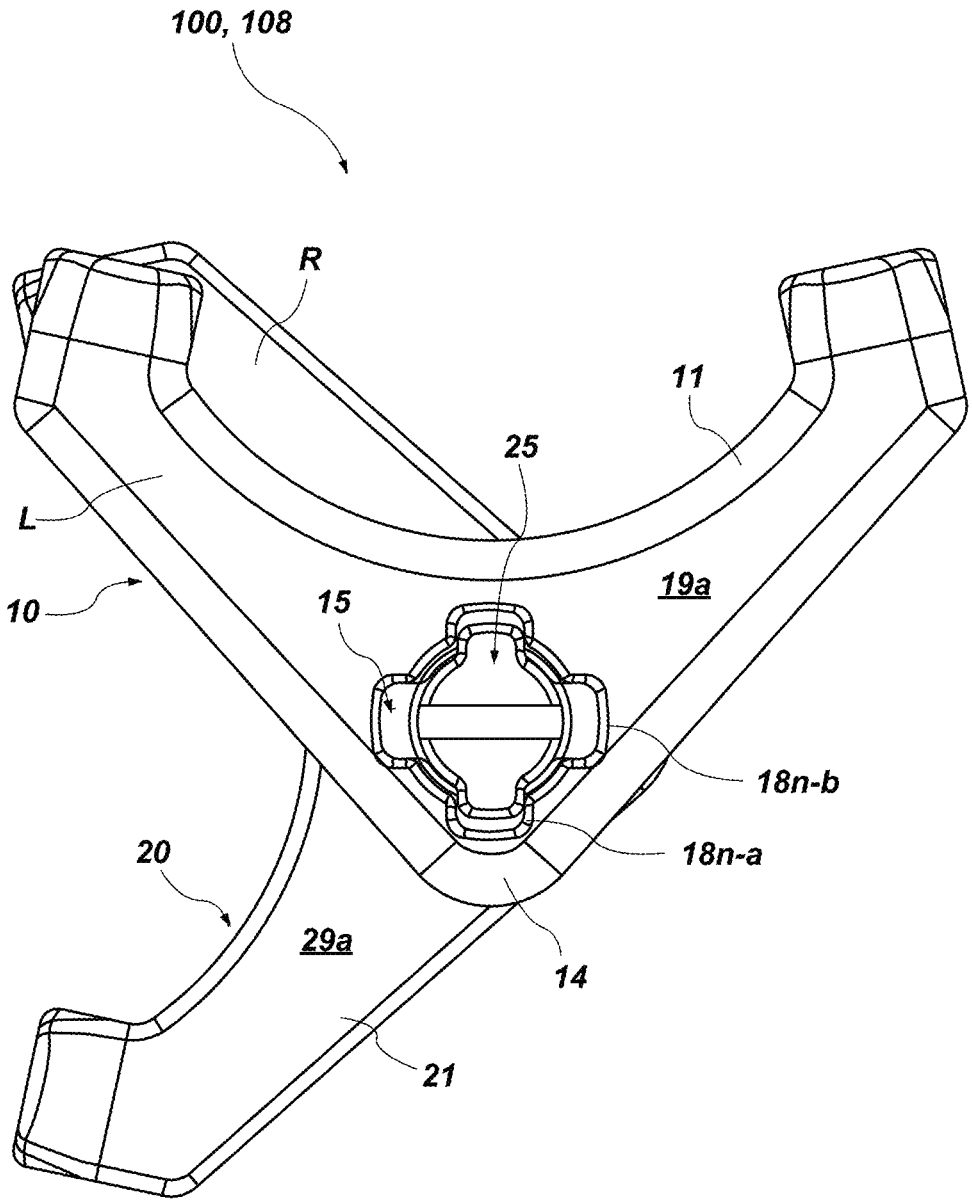
FIG. 12 is a front plan view of a second unlocked arrangement of the zipper lock of FIG. 6.
Figure 13:
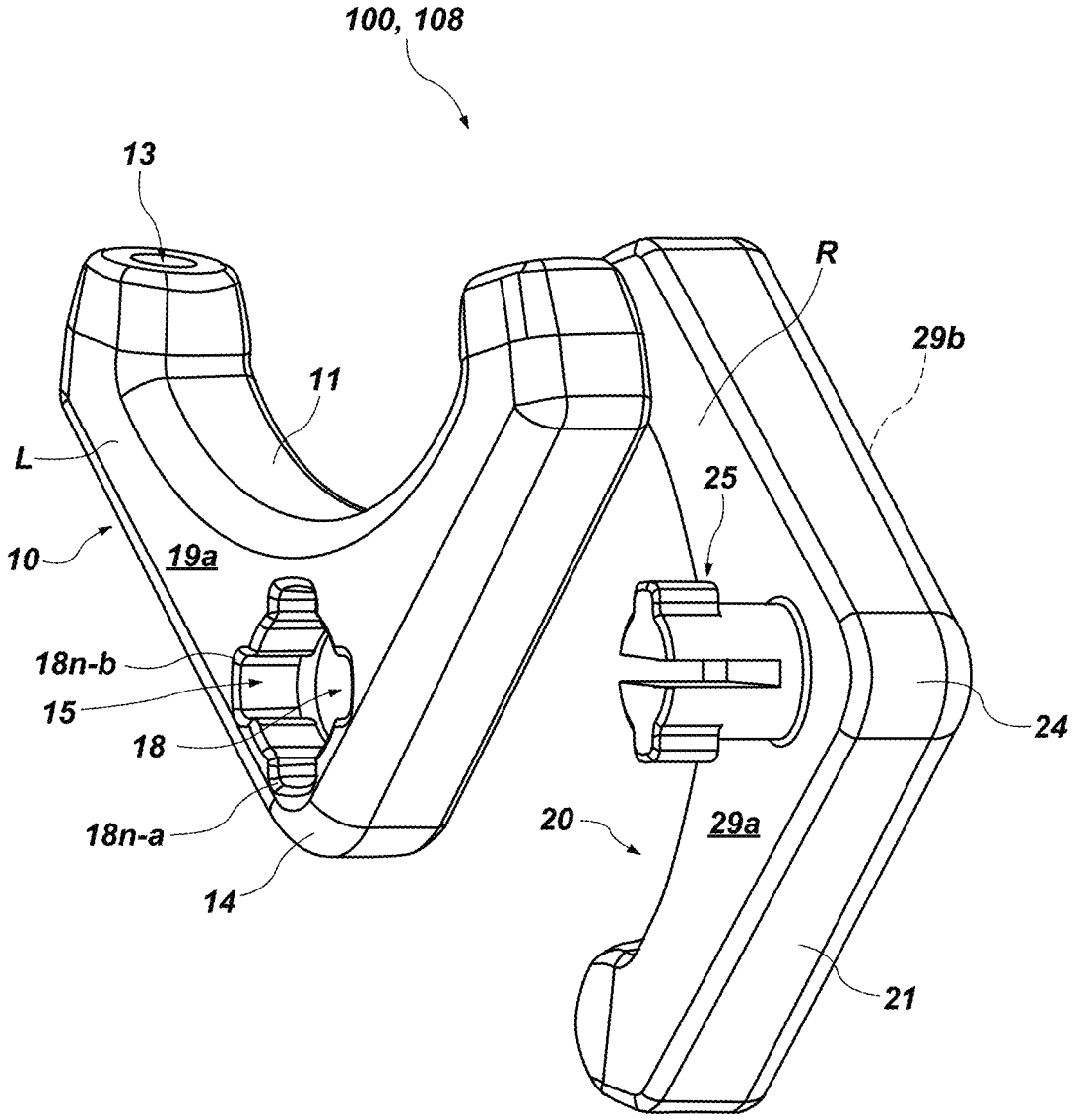
FIG. 13 is an exploded isometric view of the zipper lock in the second unlocked arrangement of FIG. 12.

FIGS. 12 and FIG. 13 show a second unlocked arrangement 108 for the zipper lock 100. In the second unlocked arrangement 108, the second pull-tab 20 is oriented approximately 90° counterclockwise in relation to the first pull-tab 10.

Also in the second unlocked arrangement 108, a portion of the back face 29*a* of the pull-tab body 21 of the second pull-tab 20 abuts or interfaces with a superimposed, opposed portion of the back face 19*b* of the pull-tab body 11 of the first pull-tab 10. Specifically, a portion of the back face 29*a* at a right arm R of the pull-tab body 21 of the second pull-tab 20 overlaps or abuts a portion of the back face 19*b* at a left arm L of the pull-tab body 11 of the first pull-tab 10. The right arm R includes the portion of the pull-tab body 21 extending between the apex 24 and the connector 22 (FIG. 3) at the top of the right arm R. The left arm L includes the portion of the pull-tab body 11 extending between the apex 14 and the connector 12 (FIG. 1) at the top of the left arm L.

FIG. 13 also illustrates the orientation of the second pull-tab 20 (e.g., oriented at about 270° to the first pull-tab 10) when the second locking coupler 25 is inserted into the first locking coupler 15 of the first pull-tab 10. Specifically, the tabs 27 are aligned with the notches 18*n* of the second void 18 of the first locking coupler 15 and the first pair of notches 16*n-a* of the first void 16. Such alignment allows the tabs 27 to be inserted first through the second void 18, past the retaining wall 17, and into the first void 16. This insertion places the first pull-tab 10 and second pull-tab 20 in the first unlocked arrangement 106 (FIGS. 10-11). The second pull-tab 20 can then be rotated clockwise 90° to bring the zipper lock 100 into the first locked arrangement 102 (FIGS. 6-7). That is, upon insertion of the tabs 27 into the first void 16 (after having passed the second void 18), the tabs 27 will have advanced past the retaining wall 17, which allows the first pull-tab 10 and second pull-tab 20 to be rotated relative to each other. Additionally, and/or alternatively, the second pull-tab 20 can be rotated counterclockwise 90° to bring the zipper lock 100 into the second locked arrangement 104 (FIGS. 10-11).

Upon rotation (either clockwise or counterclockwise), the tabs 27 of the second locking coupler 25 will be positioned adjacent to or abut the retaining wall 17 of the first locking coupler 15, preventing the tabs 27 and, thus, the second locking coupler 25 from exiting the first void 16 of the first locking coupler 15. That is, the retaining wall 17 prevents the second locking coupler 25 from being released or pulled out of the first locking coupler 15. In this way, the first pull-tab 10 is locked to the second pull-tab 20.

Figure 14:
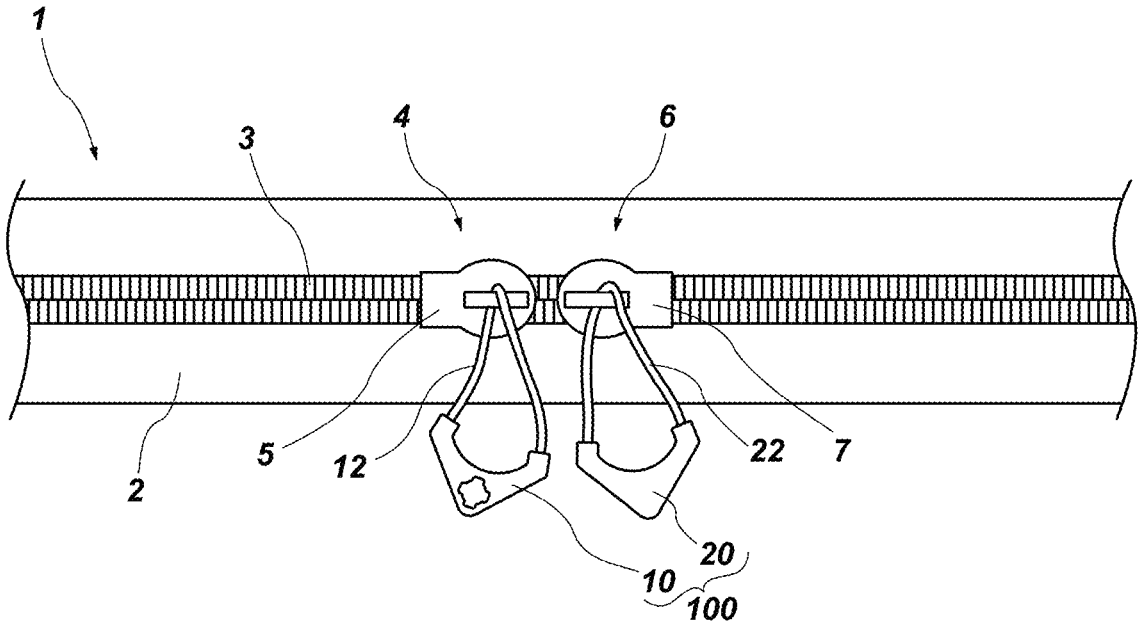
FIG. 14 depicts an embodiment of a zipper that includes a first zipper pull including the first pull-tab of FIGS. 1-2B and a second zipper pull including the second pull-tab of FIGS. 3-5.

Turning now to FIG. 14, an embodiment of a zipper 1 is illustrated. The zipper 1 includes a ribbon 2 and a track 3 with teeth, or elements, of the zipper 1. The zipper 1 also includes a first zipper pull 4 and a second zipper pull 6 along the track 3. The first zipper pull 4 includes a first slider body 5 that is carried by the ribbon 2 and track 3 and that slides along the track 3 to engage or disengage the teeth of the track 3. In addition, the first zipper pull 4 includes a first connector 12 and a first pull-tab 10 (see FIGS. 1-2B), with the first connector 12 connecting the first pull-tab 10 to the first slider body 5. The second zipper pull 6 includes a second slider body 7 that is carried by the ribbon 2 and track 3 and that slides along the track 3 to engage or disengage the teeth of the track 3. In addition, the second zipper pull 6 includes a second connector 22 and a second pull-tab 20 (see FIGS. 3-5), with the second connector 22 connecting the second pull-tab 20 to the second slider body 7. As one of the first zipper pull 4 and second zipper pull 6 is moved away from the other, the teeth of the track 3 may progressively disengage each other, opening the zipper 1 between the first zipper pull 4 and second zipper pull 6. Conversely, as one of the first zipper pull 4 and second zipper pull 6 is moved towards the other, the teeth of the track 3 may progressively engage each other, closing the zipper 1, or reducing the size of the opening in the zipper 1 between the first zipper pull 4 and second zipper pull 6. When the first pull-tab 10 and second pull tab 20 are positioned adjacent to each other, they may be placed into a locked arrangement, as described previously herein. Together, the first pull-tab 10 and second pull-tab 20 comprise a zipper lock 100.

Figure 15:
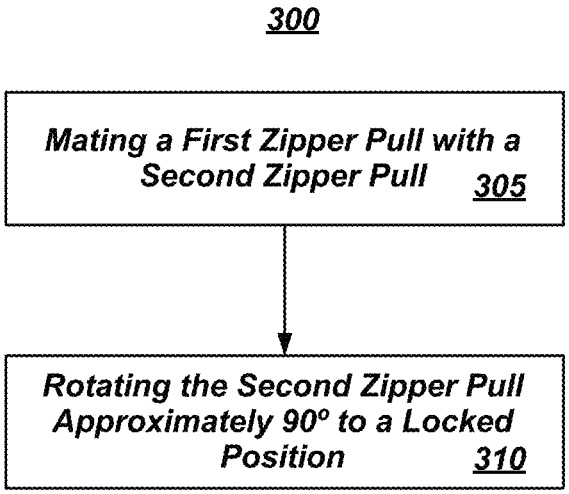
FIG. 15 is a flowchart of an embodiment of a method of locking a zipper.

FIG. 15 is a flowchart of an embodiment of a method 300 of locking a zipper. The method 300 may include mating a first pull-tab 10 (FIGS. 1-2B) with a second pull-tab 20 (FIGS. 3-5), at 305. In some embodiments, mating the first pull-tab 10 with the second pull-tab 20 includes inserting the locking coupler 25 of the second pull-tab 20 into the locking coupler 15 of the first pull-tab 10. For example, the tabs 27 of the second locking coupler 25 may be aligned with the notches 18*n* of the second void 18 of the first locking coupler 15. The protrusion 26 of the second locking coupler 25 of the second pull-tab 20 may then be inserted through the second void 18, past the retaining wall 17, and into the first void 16.

The method 300 may also include rotating the second pull-tab 20 approximately 90° to a locked position. In some embodiments, the locked position includes a first locked arrangement 102 (FIGS. 6-7) and/or a second locked arrangement 104 (FIGS. 8-9). In some embodiments, the first pull-tab 10 is rotated approximately 90° relative to the second pull-tab 20 to the locked position. In some embodiments, the rotation is counterclockwise; in some embodiments, the rotation is clockwise.

Rotation of the second pull-tab 20 causes the tabs 27 of the second locking coupler 25 to be positioned within the second pair of notches 16*n-b* of the first void 16, where the tabs 27 are positioned adjacent to and may abut or rest against the retaining wall 17 of the first locking coupler 15. In this way, the first pull-tab 10 and second pull-tab 20 are locked together. Whether the first pull-tab 10 and second pull-tab 20 are locked in the first or second locked arrangement may depend where (and in what orientation) the first pull-tab 10 and second pull-tab 20 are located on a bag, briefcase, jacket, or other item having a zipper. For example, when the first pull-tab 10 and second pull-tab 20 are adjacent each other and in a substantially parallel orientation (that is, the first pull-tab 10 and second pull-tab 20 are side-by-side), the first pull-tab 10 and second pull-tab 20 may be joined in the first locked arrangement 102 (FIGS. 6-7), where the first pull-tab 10 and second pull-tab 20 are substantially superimposed with each other. As another non-limiting example, when the first pull-tab 10 and second pull-tab 20 are opposingly facing each other (such as when the first pull-tab 10 and second pull-tab 20 are at two ends of a zipper track), the first pull-tab 10 and second pull-tab 20 may be joined together in the second locked arrangement 104 (FIGS. 8-9), where the first pull-tab 10 and second pull-tab 20 are oppositely aligned. The first locked arrangement 102 and second locked arrangement 104 allow the first pull-tab 10 and second pull-tab 20 to lock a zipper and, thus, lock a bag, apparel, or other zippered item in any orientation, thereby providing some security for the contents of the bag, apparel, or other zippered item.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

The terms "about" and "approximately" refer to numerical parameters within 10% of the indicated range. The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the author(s) of this disclosure for carrying out the embodiments disclosed herein. Of course, variations on these described embodiments will become apparent to those of ordinary skill in the art upon reading the foregoing description. The author(s) expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A zipper locking system comprising:

a first pull-tab having a triangular body, a pair of connectors protruding from the triangular body and attachable to a cable, and a mating void defined by an apex of the triangular body; and a second pull-tab having a triangular body, a pair of connectors protruding from the triangular body and attachable to a cable, and a mating protrusion integrated into an apex of the triangular body, the mating protrusion for engaging with the mating void, the zipper locking system having a first open position, a first locked position, a second open position, and a second locked position, and a transition from the first open position to the first locked position comprising an approximately 90° rotation of the second pull-tab relative to the first pull-tab when the mating protrusion is engaged with the mating void.

2. The zipper locking system of claim 1, wherein the mating void of the first pull-tab comprises a first opening and a second opening, the second opening smaller than the first opening.

3. The zipper locking system of claim 2, wherein the first opening comprises a quatrefoil opening and a retaining wall, the second opening defined by the retaining wall.

* * * * *